US005312246A

United States Patent [19]

Brock

[11] Patent Number: 5,312,246

[45] Date of Patent: May 17, 1994

[54] HEATING AND CONVEYING APPARATUS

[75] Inventor: J. Donald Brock, Chattanooga, Tenn.

[73] Assignee: Astec Industries, Inc., Chattanooga, Tenn.

[21] Appl. No.: 932,762

[22] Filed: Aug. 20, 1992

[51] Int. Cl.[5] ..... F27B 9/18

[52] U.S. Cl. ..... 432/139; 432/148; 432/151; 432/171; 432/188; 110/224

[58] Field of Search ..... 432/139, 148, 151, 171, 432/188; 110/224

[56] References Cited

U.S. PATENT DOCUMENTS 2,130,082 9/1938 Ferry .
2,795,056 6/1957 Remer .
3,827,549 8/1974 Hunter .
4,325,478 4/1982 Richard .
4,504,222 3/1985 Christian ..... 110/228
4,993,943 2/1991 Norris et al. ..... 432/111

*Primary Examiner*—Henry C. Yuen
*Attorney, Agent, or Firm*—Nilles & Nilles

[57] ABSTRACT

An apparatus for heating and conveying a granular material is disclosed, and which comprises an elongate trough, and a framework mounting a plurality of transverse blades mounted above the trough. The framework is moved along a closed path of travel so that the blades move through a forward stroke, a lifting stroke, a return stroke, and a downward stroke which returns the blades to their original position. Thus a granular material may be moved along the length of the trough in a series of sequential steps. Also, the blades are internally heated, and the bottom wall of the trough is also heated, to effect heating of the advancing granular material.

13 Claims, 2 Drawing Sheets

HEATING AND CONVEYING APPARATUS

BACKGROUND OF THE INVENTION

The present invention relates to an apparatus for heating and conveying a granular material, such as aggregate to be used in the manufacture of asphalt pavement, or recycled asphalt pavement, or oil contaminated soil.

In the production of asphalt pavement, it is known to heat granular materials, such as stone aggregate, in a rotary drum where the material to be heated is in direct contact with the hot gases coming from a burner. It is also known to heat granular materials in a screw conveyor which has hollow flights through which a heating fluid is circulated.

The above and other known processes for heating granular materials have disadvantages in the case of some materials, such as heat sensitive materials. For example, in the case of a screw conveyor, it is possible for a portion of the granular material to remain in contact with the heated flights throughout its passage through the conveyor, and so as to be overheated, while other portions are inadequately heated.

It is accordingly an object of the present invention to provide a heating and conveying apparatus for granular materials, and which overcomes the disadvantages and limitations of the prior systems.

It is also an object of the present invention to provide a heating and conveying apparatus which provides efficient transfer of heat to a granular material without exposing the material to excessively high temperatures, and which achieves substantially uniform heating of all portions of the material.

It is a further object of the present invention to provide a heating and conveying apparatus of the described type which has the ability to conveniently enclose the process so as to permit any released gases to be captured.

SUMMARY OF THE INVENTION

The above and other objects and advantages of the present invention are achieved in the embodiment illustrated herein by the provision of a heating and conveying apparatus which comprises an elongate trough, and an elongate framework mounting a plurality of longitudinally spaced apart and transversely directed, depending blades. The framework is mounted so as to be aligned above the trough, and it is moveable along a closed path of travel which includes a forward longitudinal stroke wherein the blades are disposed in the trough, a lifting stroke wherein the blades are lifted from the trough, a return longitudinal stroke wherein the blades are disposed above the trough, and a downward stroke wherein the blades are returned into the trough. The blades are heated, and drive means is provided for repeatedly moving the framework through the closed path of travel. By this movement, a granular material in the trough is sequentially moved along the trough and is heated by contact with the heated blades during movement of the framework along the forward longitudinal stroke of the path of travel.

In the preferred embodiment, the trough includes a bottom wall which is adapted to directly support the granular thereon, and the apparatus further comprises means for heating the bottom wall. Further, the blades of the framework are preferably longitudinally spaced apart from each other predetermined distances such that different portions of the granular material contact the heated blades during the sequential advance of the granular material along the trough, so as to provide substantially uniform heating of all portions of the material.

BRIEF DESCRIPTION OF THE DRAWINGS

Some of the objects and advantages of the present invention having been stated, others will appear as the description proceeds, when taken in conjunction with the accompanying drawings, in which.

DETAILED DESCRIPTION OF THE PREFERRED EMBODIMENT

Figure 1:
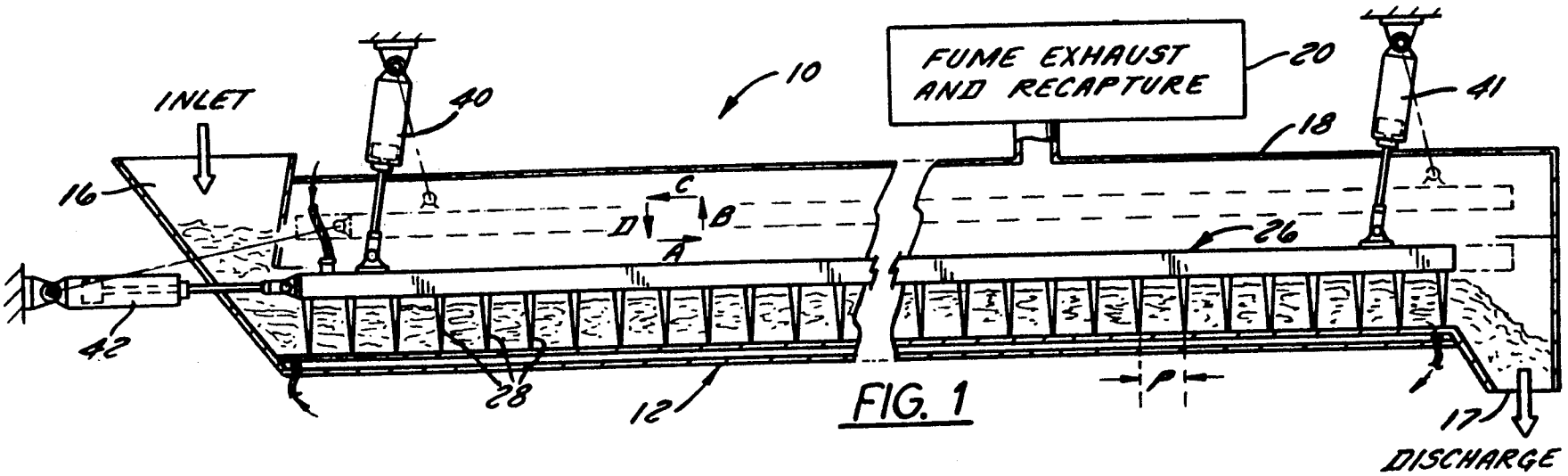
FIG. 1 is sectioned side elevation view of a heating and conveying apparatus which embodies the features of the present invention.
Figure 4:
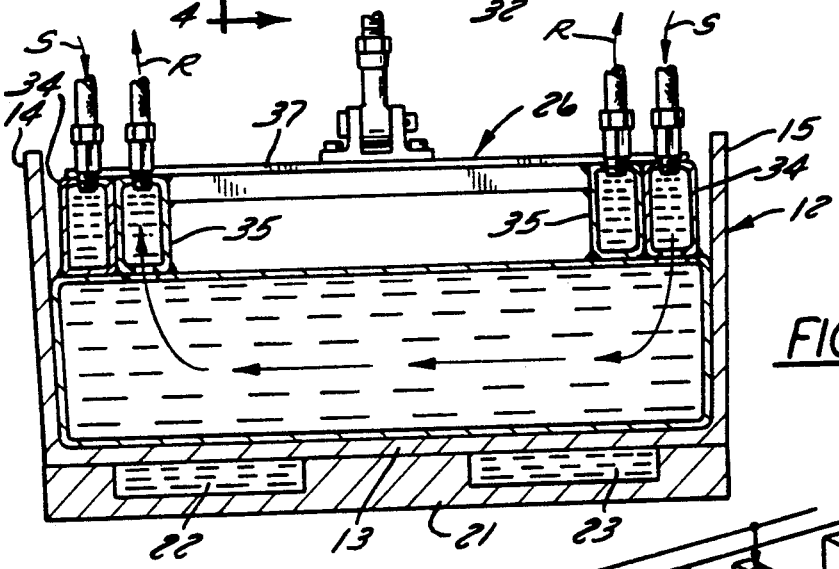
FIG. 4 is an end sectional view taken substantially along the line 4—4 of FIG. 3.

Referring more particularly to the drawings, FIG. 1 illustrates a heating and conveying apparatus at 10 which embodies the features of the present invention, and which comprises an elongate, longitudinally directed trough 12. As best seen in FIG. 4, the trough includes a flat bottom wall 13 and transversely spaced apart side walls 14, 15, so as to define a flow channel for a granular material along the length of the trough. The left end of the trough as seen in FIG. 1 includes an inlet chute 16 for directing the granular material onto the bottom wall of the trough, and the right end includes a discharge chute 17.

The trough is preferably covered with an upper wall 18 so as to enclose the trough and prevent the uncontrolled discharge of an released gases into the atmosphere. A fume exhaust and recapture system 20 may be provided which communicates with the enclosed area of the trough, as illustrated schematically in FIG. 1. In addition, an underlying plate 21 may be positioned below the bottom wall 13, with the underlying plate 21 defining a pair of fluid heating channels 22, 23 which extend along the longitudinal length of the trough, and as further described below.

Figure 2:
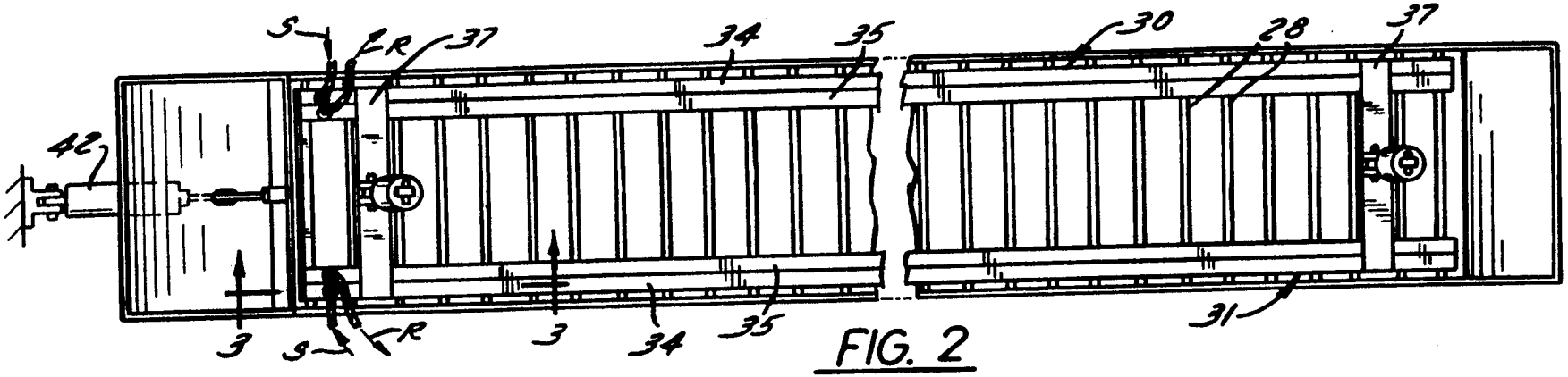
FIG. 2 is a top plan view of the apparatus shown in FIG. 1.
Figure 3:
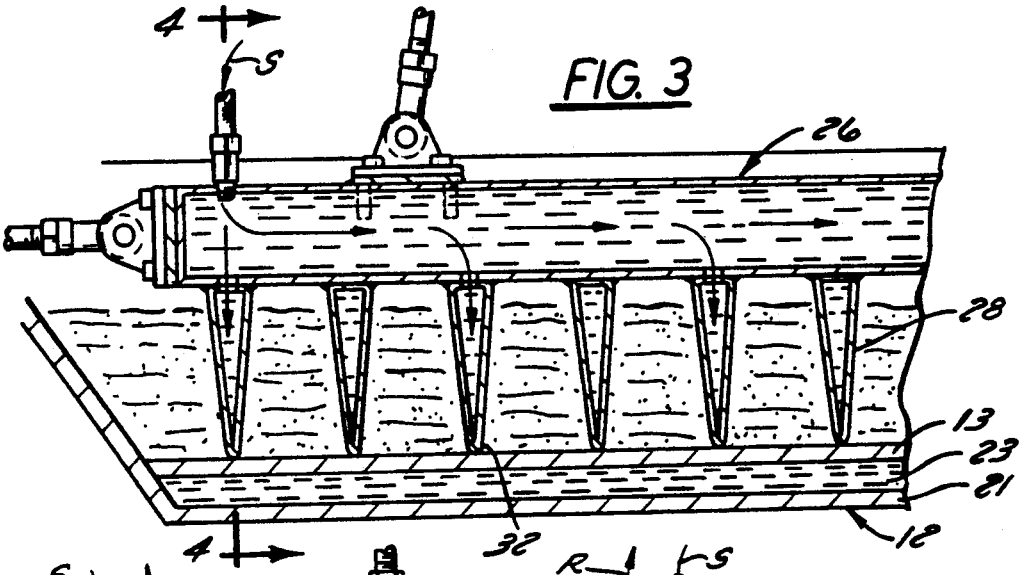
FIG. 3 is a fragmentary sectioned side elevation view taken substantially along the line 3—3 of FIG. 2.

The apparatus further comprises an elongate framework 26 which is mounted above the trough 12, and the framework 26 includes a plurality of longitudinally spaced apart and transversely directed depending hollow blades 28. More particularly, the framework 26 includes first and second longitudinal side edges 30, 31 (FIGS. 2 and 5), respectively, with the blades extending transversely between the first and second side edges. The blades 28 have a triangular cross section so as to define a relatively pointed lower edge 32 as seen in FIG. 3, and the blades are sized so as to be closely received between the side walls 14, 15 of the trough 12 as seen in FIG. 4.

Figure 5:
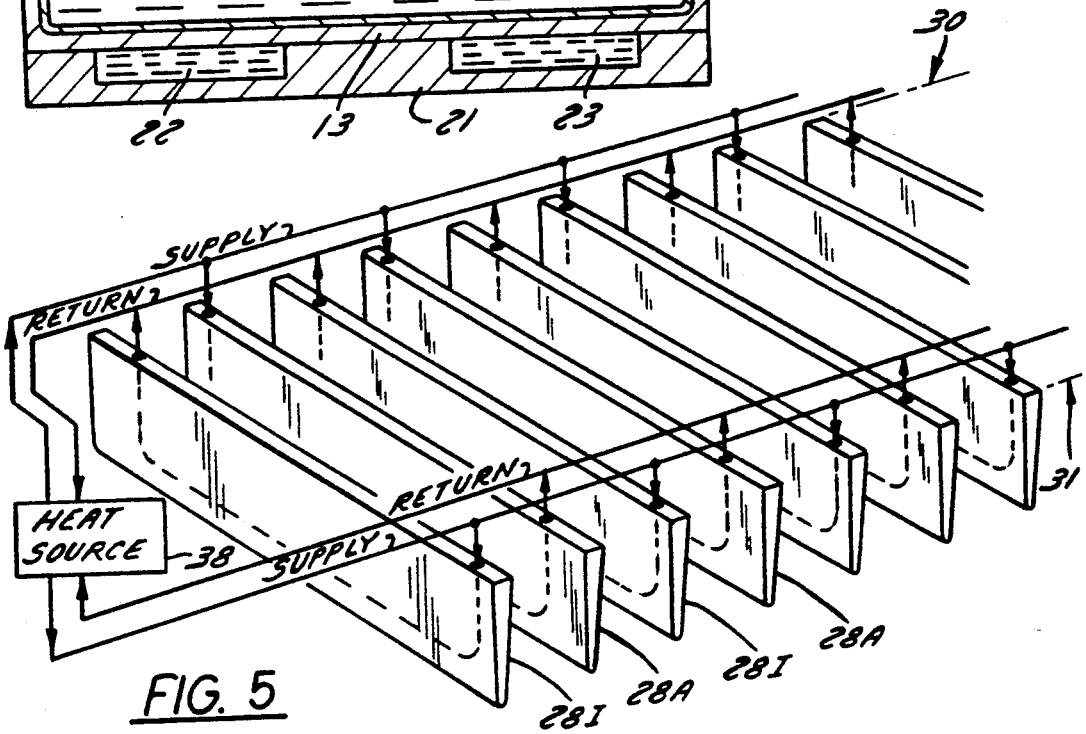
FIG. 5 is a schematic perspective view illustrating the system for circulating a heated fluid through the hollow blades of the apparatus.

The framework 26 further includes a pair of tubular channels 34, 35 extending along each of the first and second side edges 30, 31, with the channel 34 of each pair defining a fluid supply line S and the channel 35 of each pair defining a fluid return line R. The two pairs of tubular channels are transversely interconnected by a number of transverse angle braces 37 as best seen in FIGS. 2 and 4. Also, and as illustrated in FIG. 5, alternate blades 28A along the longitudinal length of the trough are in fluid communication with the fluid supply line S along the first side edge 30, and the alternate blades 28A are also in fluid communication with the return line R along the second side edge 31 of the framework. Intervening blades 281 are in fluid communication with the fluid supply line S along the second side edge 31, and also in fluid communication with the fluid return line R along the first side edge 30.

The apparatus 10 also includes means for circulating a heated fluid through the fluid supply lines and fluid return lines, and such that the heated fluid passes through the interior of adjacent blades 28 in opposite directions. This fluid circulating means includes a heat source 38 as illustrated schematically in FIG. 5, and a suitable pump (not shown). The fluid circulating means is also operatively connected to the channels 22, 23 which extend along the bottom of the trough 12.

The framework 26 is mounted so as to be aligned above the trough 12, and for movement along a closed path of travel which includes (a) a forward longitudinal stroke A wherein the blades are disposed in the trough, (b) a lifting stroke B wherein the blades are lifted from the trough, (c) a return longitudinal stroke C wherein the blades are disposed above the trough, and (d) a downward stroke D wherein the blades are returned into the trough.

The mounting means for permitting this movement includes, in the illustrate embodiment, a pair of hydraulic cylinders 40, 41 having an upper end pivotally mounted at a fixed location above the trough and a lower end pivotally mounted to the framework 26. Further, a longitudinally directed hydraulic cylinder 42 has one end pivotally mounted at a fixed location, and an opposite end pivotally connected to the framework 26.

The hydraulic cylinders 40–42 also serve as the drive means for repeatedly moving the framework 26 through the closed path of travel A, B, C, and D. More particularly, the sequential actuation of the hydraulic cylinders 40–42 effects movement of the framework 26 along the closed path of travel which is composed of the strokes A, B, C, and D.

In operation, a granular material is delivered into the trough 12 via the inlet chute 16, and the blades 28 drop into this material during the downward stroke D. In this regard, it will be understood that the pointed lower edges 32 of the blades 28 serve to facilitate the entry of the blades into the material. The material is then moved along the trough and is heated by contact with the heated blades 28 during movement of the framework along the forward longitudinal stroke A of the path of travel. In addition, the material is further heated by contact with the heated bottom wall 13. The blades 28 are then lifted from the trough during stroke B, longitudinally returned during stroke C, and then dropped back into the material during stroke D. The material is thus sequentially advanced along the full length of the trough, while being heated.

By design, the longitudinal separation, i.e. the pitch of the blades 28, is predetermined such that different portions of the granular material contact the heated blades during the sequential advance of the granular material along the trough. More particularly, in the illustrated embodiment, the forward longitudinal stroke A and the return longitudinal stroke C are of equal lengths, and the blades 28 of the framework are all longitudinally spaced apart from each other a uniform pitch P which is different from the equal lengths A and C. Thus different portions of the granular material contact the heated blades 28 during its sequential advance along the trough. As an alternative, the pitch of the blades 28 could be nonuniform, so as to provide a similar result, i.e. the blades would enter different portions of the material during the downward stroke D of their path of travel and thereby provide uniform heating. In addition, the fact that the heated fluid is circulated in opposite directions through adjacent blades 28 further contributes to the uniformity of the heating of the granular material as it moves along the trough.

In the drawings and specification, there has been set forth a preferred embodiment of the invention, and although specific terms are employed, they are used in a generic and descriptive sense only and not for purposes of limitation.

That which is claimed is:

1. An apparatus for heating and conveying a granular material, comprising an elongate trough, an elongate framework mounting a plurality of longitudinally spaced apart and transversely directed, depending blades, means mounting said framework so as to be aligned above said trough and for movement along a closed path of travel which includes (a) a forward longitudinal stroke wherein said blades are disposed in said trough, (b) a lifting stroke wherein said blades are lifted from said trough, (c) a return longitudinal stroke wherein said blades are disposed above said trough, and (d) a downward stroke wherein said blades are returned into said trough, means for heating the interiors of said blades, and drive means for repeatedly moving said framework through said closed path of travel, whereby a granular material in said trough is sequentially moved along said trough and is heated by contact with the heated blades during movement of said framework along said forward longitudinal stroke of said path of travel.

2. The apparatus as defined in claim 1 wherein said trough includes a bottom wall adapted to directly support the granular material thereon, and said apparatus further comprises means for heating said bottom wall.

3. The apparatus as defined in claim 1 wherein said blades of said framework are longitudinally spaced apart from each other predetermined distances such that different portions of the granular material contact the heated blades during the sequential advance of the granular material along said trough.

4. The apparatus as defined in claim 1 wherein said forward longitudinal stroke and said return longitudinal stroke are of equal lengths and wherein said blades of said framework are all longitudinally spaced apart from each other a uniform distance which is different from said equal lengths, whereby different portions of the granular material contact the heated blades during its sequential advance along said trough.

5. The apparatus as defined in claim 1 wherein said blades are hollow, and wherein said means for heating said blades includes means for circulating a heated fluid through said hollow blades.

6. The apparatus as defined in claim 5 wherein said means for heating said blades further comprises means for circulating the heated fluid in opposite directions through adjacent blades.

7. The apparatus as defined in claim 5 wherein said framework includes first and second longitudinal side edges, with said blades extending transversely between said first and second side edges, and said framework further includes a pair of tubular channels extending along each of said first and second side edges, with one of said channels of each pair defining a fluid supply line and the other of said channels of each pair defining a fluid return line, and alternate blades are in fluid communication with the fluid supply line along said first side edge and with the fluid return line along said second side edge, and intervening blades are in fluid communication with the fluid supply line along said second side edge and with said fluid return line along said first side edge, and said means for circulating a heated fluid through said blades includes means for circulating a heated fluid through said fluid supply lines and said fluid return lines, and such that the heated fluid passes through adjacent blades in opposite directions.

8. The apparatus as defined in claim 1 wherein said blades each have a triangular cross section so as to define a relatively pointed lower edge which facilitates the entry of the blades into the granular material during said downward stroke of said path of travel.

9. The apparatus as defined in claim 1 wherein said trough is substantially enclosed so as to permit any fumes released from the granular material in the trough to be recaptured.

10. An apparatus for heating and conveying a granular material, comprising an elongate trough, an elongate framework mounting a plurality of longitudinally spaced apart and transversely directed, depending, hollow blades, means mounting said framework so as to be aligned above said trough and for movement along a closed path of travel which includes (a) a forward longitudinal stroke wherein said blades are disposed in said trough, (b) a lifting stroke wherein said blades are lifted from said trough, (c) a return longitudinal stroke wherein said blades are disposed above said trough, and (d) a downward stroke wherein said blades are returned into said trough, means for heating said hollow blades, and including means for circulating a heated fluid in opposite directions through adjacent blades, drive means for repeatedly moving said framework through said closed path of travel, whereby a granular material in said trough is sequentially moved along said trough and is heated by contact with the heated blades during movement of said framework along said forward longitudinal stroke of said path of travel, and said blades of said framework being longitudinally spaced apart from each other predetermined distances such that different portions of the granular material contact the heated blades during its sequential advance along said trough.

11. The apparatus as defined in claim 10 wherein said trough includes a bottom wall adapted to directly support the granular material thereon, and said apparatus further comprises means for heating said bottom wall.

12. The apparatus as defined in claim 11 wherein said blades each have a triangular cross section so as to define a pointed lower end which facilitates the entry of the blades into the granular material during said downward stroke of said path of travel.

13. The apparatus as defined in claim 12 wherein said trough is substantially enclosed so as to permit any fumes released from the granular material in the trough to be recaptured.

* * * * *